United States Patent [19]

Cobb

[11] 4,206,730

[45] Jun. 10, 1980

[54] METHOD FOR RECYCLING EXHAUST GAS FROM AN INTERNAL COMBUSTION ENGINE

[75] Inventor: John M. Cobb, Cold Spring, N.Y.

[73] Assignee: Texaco Inc., White Plains, N.Y.

[21] Appl. No.: 944,943

[22] Filed: Sep. 22, 1978

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,906,909 | 9/1975 | Garcea | 123/119 A |
| 3,916,857 | 11/1975 | Naito et al. | 123/119 A |
| 4,020,809 | 5/1977 | Kern et al. | 123/119 A |
| 4,075,994 | 2/1978 | Mayer et al. | 123/119 A |
| 4,109,625 | 8/1978 | Kawamura et al. | 123/119 A |
| 4,157,081 | 6/1979 | Wake et al. | 123/119 A |

*Primary Examiner*—Wendell E. Burns

*Attorney, Agent, or Firm*—Carl G. Ries; Robert A. Kulason; Robert B. Burns

[57] ABSTRACT

Method for recycling exhaust gas from a fuel injection engine, wherein the speed of the engine, as well as the rate of the fuel injection to the engine combustion chambers, are the determining factors in regulating the flow rate of exhaust gas to the engine's intake manifold.

8 Claims, 2 Drawing Figures

METHOD FOR RECYCLING EXHAUST GAS FROM AN INTERNAL COMBUSTION ENGINE

BACKGROUND OF THE INVENTION

In the operation of any internal combustion engine, the practice of recycling a certain amount of exhaust gas from the exhaust, to the engine intake manifold is well known. Such a practice is found to be effective toward reducing the amount of harmful constituents which would otherwise be discharged into the atmosphere. Further, the gas recycling procedure can be practiced in a manner to not substantially interfere with the efficiency of the engine.

Normally, in a premixed or carbureted charge to an engine, the rate of exhaust gas recycling is controlled by the degree of vacuum which exists in the engine intake manifold. It could, however, be responsive to the vacuum established at another point that is subject to a varying vacuum condition in response to engine load and speed.

In the instance of a fuel injection engine of the type presently considered, a relatively constant air charge is introduced to each combustion chamber. Over the range of operation, there will be no vacuum variations indicative of the engine's immediate operating condition. To properly vary the exhaust gas recycling rate then, means must be provided to in effect establish an artificial vacuum condition. The latter can then be modified in response to the engine's speed and load condition.

In the instant arrangement, a fuel injection engine of the type contemplated is provided, with a valve member for varying the volume of exhaust gas flow from the engine exhaust conduit, to the air intake manifold. This valve member is subject to adjustment for altering said gas flow, in a manner that is determined by the degree of vacuum imposed on an exhaust gas flow controller. The vacuum condition is in turn varied in response to the physical adjustment of an air bleed orifice which leaks air into the vacuum system. The orifice is provided with an adjustable constricted opening which functions to permit a certain amount of air to leak into the vacuum system, thereby to in effect alter the setting of the exhaust gas flow controller.

It is therefore an object of the invention to provide an exhaust gas recycling loop or cycle for an internal combustion engine. A further object is to provide an exhaust gas recycling system in an engine which is adapted to operate on the fuel injection principle wherein no substantial degree of vacuum is achieved in the intake manifold, which might be utilized as the control medium.

Another object is to provide a method for efficiently circulating an amount of internal combustion exhaust gas as to more effectively adjust flow of the latter.

Toward overcoming the above stated problems, and toward achieving the enumerated objectives, the applicant has provided a method which utilizes an adjustable flow exhaust gas recirculating system. The latter is capable of passing a flow of hot exhaust gas from the engine's exhaust carrying conduit to a point where it will mix with air which is introduced to the various combustion chambers.

To power the system, a constant source of vacuum is provided in the form of a vacuum pump or other vacuum establishing element which is normally driven by the engine. Since the degree of vacuum imposed on the exhaust gas controller will regulate the exhaust gas flow, the magnitude of the vacuum is adjusted by bleeding air into the system through an adjustable orifice. Said orifice comprises an adjustable unit having a venting arrangement such that air might pass through the unit's constricted portion and into the vacuum segment of the system.

The adjustable orifice or air bleed valve is automatically regulated to provide the necessary degree of air bleed in response to the disposition of the engine fuel pump. The latter is provided with an operable element capable of affording an indication of the fuel flow to each combustion chamber. The fuel pump is further provided with means to monitor the speed of the engine. These two sources of information, or signals corresponding thereto, are transmitted to the adjustable orifice in the form of dual responses whereby to effect the proper orifice adjustment.

DESCRIPTION OF THE DRAWINGS

In the drawings,

Referring to FIG. 1, the internal combustion engine 10 contemplated is of the type adapted to be charged for operation on the fuel injection principle. Said engine thus includes a block 11 having a plurality of internal cylinders, each of which embodies a valved or ported combustion chamber.

Figure 1:
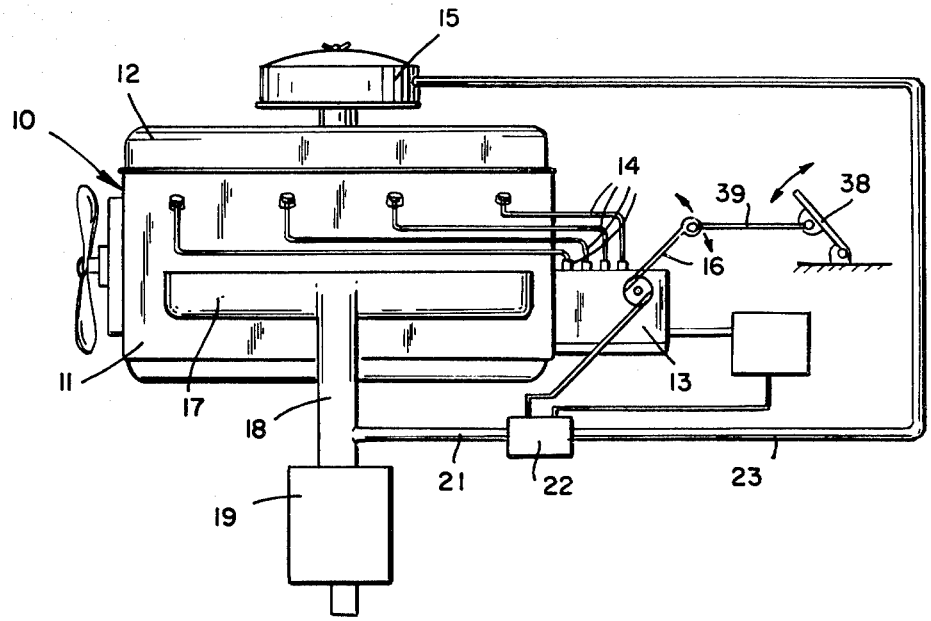
FIG. 1 illustrates schematically an internal engine of the type contemplated with the instant exhaust gas control circuit.

A fuel charge is delivered to the respective combustion chambers through an air intake manifold 12 which is in turn communicated with an air filter 15 for cleaning air which enters the combustion chambers. In the normal manner a liquid fuel is metered by injectors to the respective combustion chambers in a desired amount by way of a fuel pump 13. The latter includes a plurality of fuel lines 14, each of which extends from pump 13 to a discrete combustion chamber injector.

In the operation of fuel pumps of the type contemplated, a fuel flow actuating lever or arm 16 is operable, normally in an arcuate path. Thus, the amount of fuel injected into each combustion chamber is equal, and is also proportional to displacement of said arm 16.

Subsequent to the combustion event in each combustion chamber, the resulting hot exhaust gases are forced into an exhaust gas manifold 17. They are then directed through an exhaust pipe 18 to a muffler 19. Toward minimizing or avoiding the discharge of the harmful constituents of such exhaust gases into the atmosphere, the present exhaust gas recycling system is provided.

The latter includes in effect a first conduit 21 which receives a portion of the exhaust gas stream from the exhaust gas pipe 18. Said conduit 21 is communicated with an exhaust gas flow control valve 22, which is in turn communicated by way of conduit 23, with air intake means. In the present arrangement as shown, air from exhaust flow control valve 22 is communicated with air filter 15, although it may be communicated as well directly to the air intake manifold 12.

Figure 2:
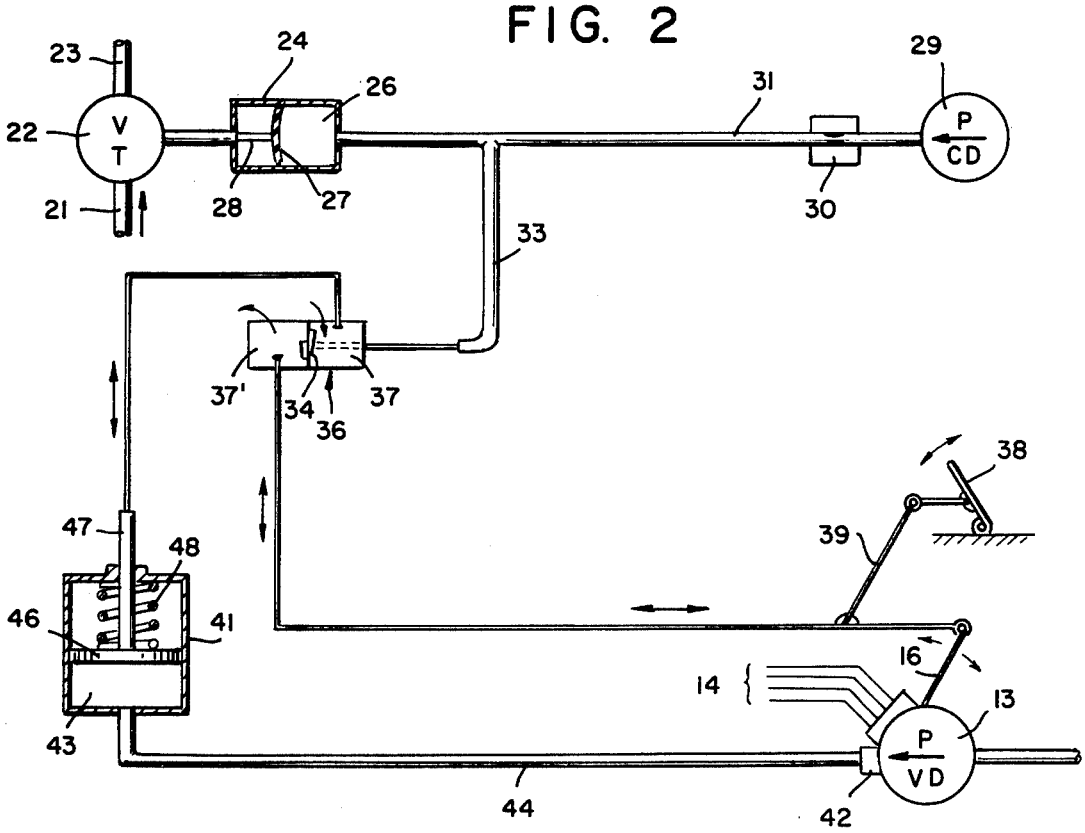
FIG. 2 is a schematic illustration of the exhaust gas control circuit.

Referring to FIG. 2, the exhaust gas stream at 21 is regulated through valve member 22 which is disposed between gas conduits 21 and 23. Said valve member 22 is in turn adjusted responsive to movement of first valve actuator 24. The latter in one embodiment includes a plenum chamber 26 together with a displaceable diaphragm 27 positioned transversely of the chamber.

Diaphragm 27 is fixedly connected to valve operator 28 such that the latter will be displaced in response to a pressure or vacuum condition within plenum chamber 26. Chamber 26 is communicated by line 31 with a source of constant vacuum such as a vacuum pump 29 or the like. Pump 29 is operably connected to be driven by engine 10, or it can be run independently so long as it functions to establish the evacuated atmosphere.

Pump 29 is communicated directly with the plenum chamber 26 of the first valve actuator 24, through a fixed restriction 30 formed in connecting line 31. Operationally, vacuum source 29 is regulated by suitable valving or speed control means, to assure a relatively stable degree of vacuum.

Normally for a particular engine condition, a relatively constant degree of vacuum will be applied to plenum chamber 26. Valve operator 28 will thereby be positioned in a desired setting to adjust the flow opening in valve 22 and allow a predetermined stream of exhaust gas to pass through said exhaust gas flow control valve. However, the actual vacuum condition at valve actuator 24 is adjusted in response to air leakage through adjustable orifice 34.

The latter is operable to permit a desired rate of air to bleed into the vacuum system by way of vent 32, line 33 and line 31. Any alteration of the level of vacuum in chamber 26 will be reflected in the degree of displacement of diaphragm 27.

In one embodiment, adjustable air bleed valve 36 includes in essence a valve member having at least two cooperative elements 37 and 37' which are rotatably adjustable with respect to each other, and which together operate to define or regulate orifive 34 through which air is bled. Element 37 of valve 36 is communicated with the partially evacuated system through line 33 as herein noted. Thus air will be drawn through the valve inlet side or adjustable orifice 34, and be bled into the vacuum system. The size, or opening defined by orifice 34 will determine the rate of air influx.

In one embodiment of air bleed valve 36, valve elements 37 and 37' are mounted longitudinally on a longitudinal axis. Further, each of said elements 37 and 37' can be independently rotated on the axis. Rotational adjustment of either movable element will vary the cross sectional opening of the common orifice 34 defined therebetween. Adjustment of the orifive 34 opening, therefore, is contingent on the concurrent action of two factors of engine operation, i.e., engine speed and load.

As shown in FIG. 2, element 37' of valve 36 is rotatably mounted, and operable in response to the positioning of arm 16 on the fuel injection pump 13. Thus, as the lever 16 becomes displaced in response to movement of the throttle control pedal 38 through the connecting linkage 39, the rate of fuel fed to the respective combustion chambers will be altered. Element 37' will be commensurably rotated.

The opening size of orifice 34 in air bleed valve 36 is further contingent on the condition of engine 10 with respect to actual speed. The instant system will thereby function regardless of the actual load imposed on the engine.

In one embodiment, fuel pump 13 is operably connected to an engine rotative member such that engine speed will be registered in the fuel injector pump and provide a signal which is proportional to said engine speed. In the present arrangement, a pressure signal at pump outlet 42 is provided.

The speed signal is communicated with the speed modulator element 41. The latter includes in one embodiment, a plenum chamber 43 which is communicated with injection pump outlet 42 through a line 44. Plenum chamber 43 is defined by a bellows 46, or similar displaceable member which is capable of maintaining a fluid tight condition. Bellow 46 is fixed at its movable end to an elongated actuating arm 47 which is longitudinally carried within the casing of the speed modulator 41.

A biasing member such as spring 48 acts against bellows 46, and forces it into a normal downward or neutral position.

As engine speed is adjusted, the pressure signal from fuel pump 13 is increased, thereby increasing pressure in chamber 43 and consequently urging actuating arm 47 upwardly. Said arm 47 is in turn operably engaged with element 37 of the bleed valve 36 to adjust the orifice 34 opening size. Thus, as the engine speed is varied, arm 47 will immediately function to adjust the opening of orifice 34.

Functionally, for a particular engine speed and loading, the rate of fuel injection to the various combustion chambers will be controlled by the operator in the usual manner. This control will normally be exercised by way of the adjustment of the foot or hand lever 38 which is connected, as herein noted, by linkage 39 to movable arm 16 of the fuel injector pump 13.

Therefore, whether the engine be running at high or low speed, or whether at low or full load, each of the factors will operate to determine the orifice opening 34. Each of said factors will thus be a determinant in the amount of exhaust gas which is recycled through valve 22.

Other modifications and variations of the invention as hereinbefore set forth can be made without departing from the spirit and scope thereof, and therefore, only such limitations should be imposed as are indicated in the appended claims.

I claim:

1. A method for operating an internal combustion engine having at least one fuel injection pump for injecting fuel into the engine's combustion chamber, and having an intake manifold for introducing air to said combustion chamber, and into which combustion chamber a stream of exhaust gas is recycled from the engine's exhaust manifold, which method comprises the steps of;

providing an exhaust gas recycle circuit which communicates said exhaust manifold with the intake manifold, said recycle circuit including a first flow control means having an adjustable flow passage through which said stream of exhaust gas flows, and said first flow control means having a signal responsive actuator operably connected therewith to adjust said flow passage, and actuating said first flow control means actuator, whereby to adjust the flow passage of said first flow control means in response to the rate of fuel input, and to the speed output of said engine.

2. In the method as defined in claim 1, including the steps of; continuously monitoring the fuel flow rate to the combustion chamber, as well as the engine speed output to obtain first and second signals respectively introduced to said signal responsive actuator.

3. In the method as defined in claim 2, including the step of; combining said first and second signals into a common signal for introduction thereof to said actuator.

4. In the method as defined in claim 3, wherein said common signal is continuously introduced to said signal responsive actuator whereby to adjust the first flow control means.

5. Method for operating a fuel injection internal combustion engine having at least one fuel injection pump for injecting fuel into the engine'c combustion chamber, and having an intake manifold for introducing air to said combustion chamber, and into which combustion chamber a stream of exhaust gas is recycled from the engine exhaust manifold, which method comprises the steps of;

providing an exhaust gas recycle circuit which communicates said exhaust manifold with the engine air intake manifold, said recycle circuit including a first flow control valve having an adjustable flow passage through which said stream of exhaust gas flows, said first flow control valve having a signal responsive plenum chamber operably connected therewith to adjust the flow passage in response to the pressure in said plenum chamber, forming a first signal which corresponds to the rate of fuel injection into the combustion chamber, forming a second signal which corresponds to the speed of said engine, and introducing said first and second signals respectively into said signal responsive plenum chamber whereby the latter will cause said first flow control valve to adjust, and thereby regulate the volume of exhaust gas passing therethrough.

6. In the method as defined in claim 5, including the step of; subjecting said first valve plenum chamber to a vacuum condition, and adjusting the degree of vacuum thereon in response to engine fuel rate and to engine speed.

7. In the method as defined in claim 6, including the step of; leaking a flow of air into said plenum chamber to diminish the degree of vacuum acting thereon.

8. In the method as defined in claim 7, wherein the flow of air leaked into said valve actuator plenum chamber is adjusted in response to variations in the fuel rate to the engine and to engine speed.

* * * * *